US009784117B2

(12) United States Patent
Duguay et al.

(10) Patent No.: US 9,784,117 B2
(45) Date of Patent: Oct. 10, 2017

(54) TURBINE ENGINE TIP CLEARANCE CONTROL SYSTEM WITH ROCKER ARMS

(71) Applicant: United Technologies Corporation, Hartford, CT (US)

(72) Inventors: Brian Duguay, Berwick, ME (US); Timothy M. Davis, Kennebunk, ME (US)

(73) Assignee: United Technologies Corporation, Farmington, CT (US)

( * ) Notice: Subject to any disclaimer, the term of this patent is extended or adjusted under 35 U.S.C. 154(b) by 140 days.

(21) Appl. No.: 14/731,140

(22) Filed: Jun. 4, 2015

(65) Prior Publication Data

US 2016/0356169 A1 Dec. 8, 2016

(51) Int. Cl.

| | |
|---|---|
| ***F01D 11/22*** | (2006.01) |
| ***F01D 11/14*** | (2006.01) |
| ***F01D 11/20*** | (2006.01) |

(52) U.S. Cl.

CPC ..... *F01D 11/22* (2013.01); *F01D 11/14* (2013.01); *F01D 11/20* (2013.01)

(58) Field of Classification Search

None

See application file for complete search history.

(56) References Cited

U.S. PATENT DOCUMENTS

| | | | |
|---|---|---|---|
| 4,332,523 | A | 6/1982 | Smith |
| 5,018,942 | A | 5/1991 | Ciokajlo et al. |
| 5,035,573 | A | 7/1991 | Tseng et al. |
| 5,049,033 | A | 9/1991 | Corsmeier et al. |
| 5,054,997 | A | 10/1991 | Corsmeier et al. |
| 5,056,988 | A | 10/1991 | Corsmeier et al. |
| 5,096,375 | A | 3/1992 | Ciokailo |
| 5,104,287 | A | 4/1992 | Ciokajlo |
| 5,228,828 | A | 7/1993 | Damlis et al. |
| 5,362,202 | A | 11/1994 | Derouet et al. |
| 5,545,007 | A | 8/1996 | Martin |
| 8,376,691 | B2 | 2/2013 | Wulf |
| 8,434,997 | B2 | 5/2013 | Pinero et al. |
| 8,734,090 | B2 | 5/2014 | Lewis |
| 8,934,997 | B2 | 1/2015 | Lambourne |
| 2006/0013683 | A1 | 1/2006 | Martindale |

(Continued)

FOREIGN PATENT DOCUMENTS

| | | | |
|---|---|---|---|
| DE | WO 2009067992 A2 * | 6/2009 | ..... F01D 11/22 |
| GB | 2099515 A | 12/1982 | |
| WO | 2014160953 | 3/2014 | |

OTHER PUBLICATIONS

EP search report for EP16163706.1 dated Nov. 18, 2016.
EP search report for EP16163680.8 dated Nov. 18, 2016.
Office action for U.S. Appl. No. 14/731,155 dated Dec. 22, 2017.

*Primary Examiner* — Dwayne J White
*Assistant Examiner* — Theodore Ribadeneyra
(74) *Attorney, Agent, or Firm* — O'Shea Getz P.C.

(57) ABSTRACT

An assembly is provided for a turbine engine with an axial centerline. This turbine engine assembly includes a blade outer air seal segment, a linkage, a rocker arm and an actuation device. The linkage is attached to the blade outer air seal segment. The rocker arm includes a first arm and a second arm engaged with the linkage. The actuation device is engaged with the first arm. The actuation device is configured to pivot the rocker arm and thereby radially move the blade outer air seal segment.

20 Claims, 5 Drawing Sheets

(56) References Cited

U.S. PATENT DOCUMENTS

| | | | | |
|---|---|---|---|---|
| 2007/0020095 | A1 | 1/2007 | Dierksmeier et al. | |
| 2012/0063884 | A1 | 3/2012 | Klingels | |
| 2014/0212262 | A1 | 7/2014 | Harris | |
| 2014/0271147 | A1 | 9/2014 | Uskert et al. | |
| 2015/0218959 | A1* | 8/2015 | Barb | F01D 11/22 415/173.1 |
| 2016/0265380 | A1 | 9/2016 | Davis et al. | |

* cited by examiner

TURBINE ENGINE TIP CLEARANCE CONTROL SYSTEM WITH ROCKER ARMS

This invention was made with government support under Contract No. FA8650-09-D-2923 0021 awarded by the United States Air Force. The government may have certain rights in the invention.

BACKGROUND OF THE INVENTION

1. Technical Field

This disclosure relates generally to a turbine engine and, more particularly, to tip clearance control for a turbine engine.

2. Background Information

Various systems are known in the art for controlling clearance between rotor blade tips and a surrounding blade outer air seal (BOAS). Typical active and passive tip clearance control systems react much too slowly to achieve small tip clearances at engine time points of most interest, such as cruise. Those systems also lack the ability to compensate for thermal/mechanical distortions of one or more of the components, further limiting their ability to control tip clearance. Attempts to more-rapidly and precisely position the BOAS, for example through the use of a pneumatically-controlled actuation system, can be very complex and costly.

There is a need in the art for an improved tip clearance control system.

SUMMARY OF THE DISCLOSURE

According to an aspect of the disclosure, an assembly is provided for a turbine engine with an axial centerline. This turbine engine assembly includes a blade outer air seal segment, a linkage, a rocker arm and an actuation device. The linkage is attached to the blade outer air seal segment. The rocker arm includes a first arm and a second arm engaged with the linkage. The actuation device is engaged with the first arm. The actuation device is configured to pivot the rocker arm and thereby radially move the blade outer air seal segment.

According to another aspect of the disclosure, another assembly is provided for a turbine engine with an axial centerline. This turbine engine assembly includes a plurality of blade outer air seal segments arranged around the axial centerline. The turbine engine assembly also includes a tip clearance control system which includes a plurality of rocker arms and an actuation ring. The rocker arms are arranged around the blade outer air seal segments. Each of the rocker arms is operatively connected between a respective one of the blade outer air seal segments and the rotatable actuation ring. The actuation ring is configured to circumferentially rotate and thereby cause the rocker arms to pivot and move the blade outer air seal segments.

The tip clearance control system may include a plurality of linkages. Each of the linkages may be engaged with and extend radially between a respective one of the blade outer air seal segments and a respective one of the rocker arms.

The tip clearance control system may include a plurality of sloped slide blocks which respectively axially engage the rocker anus and are connected to the actuation ring. The actuation ring may be configured to circumferentially move the sloped slide blocks and thereby axially push against the rocker arms.

A turbine engine case may be included radially between the blade outer air seal segments and the rocker arms.

Each of the rocker arms may include a base, a first arm and a second arm. The base may be pivotally attached to the turbine engine case. The first and the second arms may project out from the base. The first arm may be operatively connected with a respective one of the blade outer air seal segments. The second arm may be operatively connected with the actuation ring.

The first arm may project axially out from the base. In addition or alternatively, the second arm may project radially out from the base.

A turbine engine case may be included, where the linkage extends radially through an aperture in the turbine engine case.

The rocker arm may include a base pivotally attached to the turbine engine case. The first and the second arms may project out from the base.

The first arm may project axially out from the base. In addition or alternatively, the second arm may project radially out from the base.

The first arm may be clocked from the second arm by between eighty-five degrees and ninety-five degrees. For example, the first arm may be perpendicular to the second arm.

The actuation device may axially engage the second arm.

The actuation device may laterally and radially slideably contact the second arm.

The actuation device may be operable to move radially relative to the second arm without pivoting the rocker arm.

The actuation device may include a sloped slide block which axially engages the second arm. The actuation device may be configured to laterally move the sloped slide block and thereby axially push the second arm with the sloped slide block.

The actuation device may include a rotatable actuation ring to which the sloped slide block is connected.

The linkage may extend radially from the blade outer air seal segment to the second arm. The second arm may be operable to radially translate the linkage.

The linkage may be substantially constrained to radial translation.

The linkage may include a shaft and a head that radially engages the second arm. The shaft may extend radially away from the blade outer air seal segment, through an aperture in the second arm, and to the head.

A rotor may be included with a plurality of rotor blades. Each of the rotor blades may extend radially outward to a tip. The actuation device may be operable to radially move the blade outer air seal segment to reduce air leakage between the tip and the blade outer air seal segment.

The foregoing features and the operation of the invention will become more apparent in light of the following description and the accompanying drawings.

DETAILED DESCRIPTION OF THE INVENTION

Figure 1:
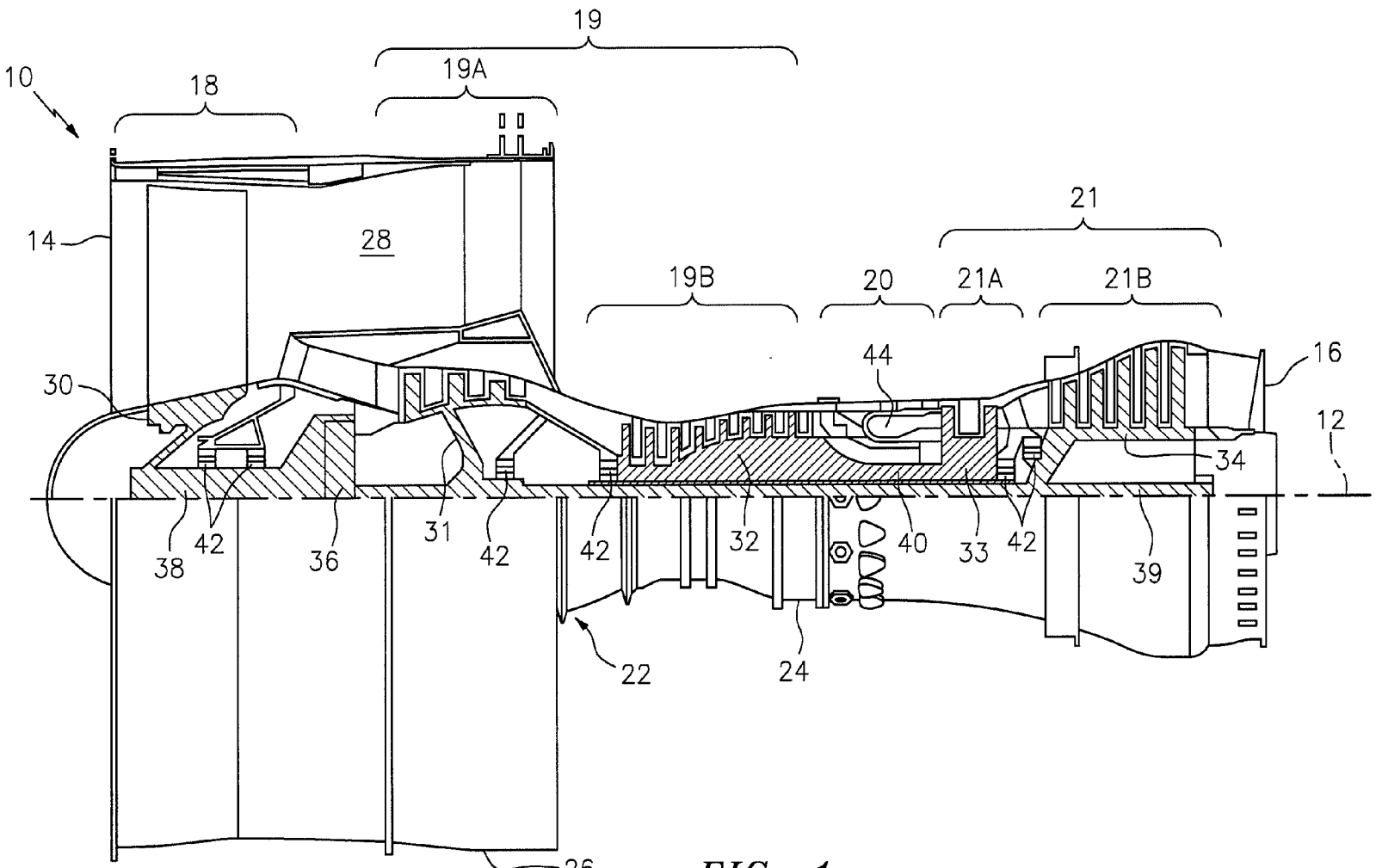
FIG. 1 is a side cutaway illustration of a geared turbine engine.

FIG. 1 is a side cutaway illustration of a geared turbine engine 10. This turbine engine 10 extends along an axial centerline 12 between an upstream airflow inlet 14 and a downstream airflow exhaust 16. The turbine engine 10 includes a fan section 18, a compressor section 19, a combustor section 20 and a turbine section 21. The compressor section 19 includes a low pressure compressor (LPC) section 19A and a high pressure compressor (HPC) section 19B. The turbine section 21 includes a high pressure turbine (HPT) section 21A and a low pressure turbine (LPT) section 21B.

The engine sections 18-21 are arranged sequentially along the centerline 12 within an engine housing 22. This housing 22 includes an inner case 24 (e.g., a core case) and an outer case 26 (e.g., a fan case). The inner case 24 may house one or more of the engine sections 19-21 (e.g., an engine core), and may be housed within an inner nacelle (not shown) which provides an aerodynamic cover for the inner case 24. The inner case 24 may be configured with one or more axial and/or circumferential inner case segments. The outer case 26 may house at least the fan section 18, and may be housed within an outer nacelle (not shown) which provides an aerodynamic cover for the outer case 26. Briefly, the outer nacelle along with the outer case 26 overlaps the inner nacelle thereby defining a bypass gas path 28 radially between the nacelles. The outer case 26 may be configured with one or more axial and/or circumferential outer case segments.

Each of the engine sections 18-19B, 21A and 21B includes a respective rotor 30-34. Each of these rotors 30-34 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 30 is connected to a gear train 36, for example, through a fan shaft 38. The gear train 36 and the LPC rotor 31 are connected to and driven by the LPT rotor 34 through a low speed shaft 39. The HPC rotor 32 is connected to and driven by the HPT rotor 33 through a high speed shaft 40. The shafts 38-40 are rotatably supported by a plurality of bearings 42; e.g., rolling element and/or thrust bearings. Each of these bearings 42 is connected to the engine housing 22 by at least one stationary structure such as, for example, an annular support strut.

During operation, air enters the turbine engine 10 through the airflow inlet 14. This air is directed through the fan section 18 and into a core gas path 42 and the bypass gas path 28. The core gas path 42 extends sequentially through the engine sections 19-21. The air within the core gas path 42 may be referred to as "core air". The air within the bypass gas path 28 may be referred to as "bypass air".

The core air is compressed by the compressor rotors 31 and 32 and directed into a combustion chamber of a combustor 44 in the combustor section 20. Fuel is injected into the combustion chamber and mixed with the compressed core air to provide a fuel-air mixture. This fuel air mixture is ignited and combustion products thereof flow through and sequentially cause the turbine rotors 33 and 34 to rotate. The rotation of the turbine rotors 33 and 34 respectively drive rotation of the compressor rotors 32 and 31 and, thus, compression of the air received from a core airflow inlet. The rotation of the turbine rotor 34 also drives rotation of the fan rotor 30, which propels bypass air through and out of the bypass gas path 28. The propulsion of the bypass air may account for a majority of thrust generated by the turbine engine 10, e.g., more than seventy-five percent (75%) of engine thrust. The turbine engine 10 of the present disclosure, however, is not limited to the foregoing exemplary thrust ratio.

Figure 2:
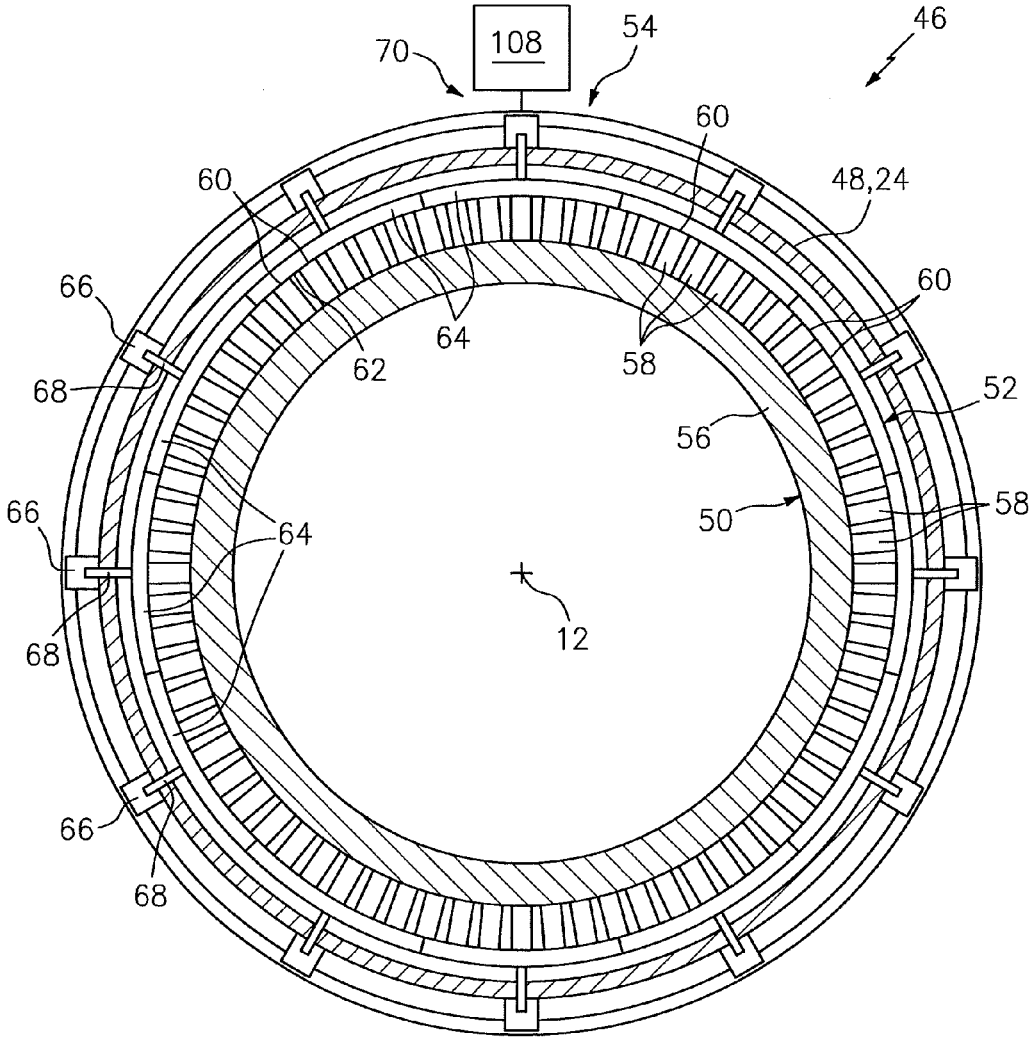
FIG. 2 is an end cutaway illustration of an assembly for the turbine engine.

FIG. 2 illustrates an assembly 46 for the turbine engine 10. This turbine engine assembly 46 includes a turbine engine case 48, a rotor 50, a blade outer air seal 52 ("BOAS") and a tip clearance control system 54. It is worth noting, a blade outer air seal may also be referred to as a shroud.

The turbine engine case 48 may be configured as or part of the inner case 24. The turbine engine case 48, for example, may be configured as an axial tubular segment of the inner case 24 for housing some or all of the HPT rotor 33.

The rotor 50 may be configured as or included in one of the rotors 30-34; e.g., the HPT rotor 33. This rotor 50 includes a rotor disk 56 and a set of rotor blades 58. The rotor blades 58 are arranged circumferentially around and connected to the rotor disk 56. Each of the rotor blades 58 extends radially out from the rotor disk 56 to a respective rotor blade tip 60.

The blade outer air seal 52 circumscribes the rotor 50 and is housed radially within the turbine engine case 48. The blade outer air seal 52 is configured to reduce or eliminate gas leakage across the tips 60 of the rotor blades 58. The blade outer air seal 52 may be configured from or include abradable material. This abradable material, when contacted by one or more of the tips 60 during turbine engine 10 operation, may abrade to prevent damage to those rotor blades 58 as well as enabling provision of little to no gaps radially between the tips 60 and an inner surface 62 of the blade outer air seal 52.

The blade outer air seal 52 includes a plurality of blade outer air seal ("BOAS") segments 64. These BOAS segments 64 are arranged in an annular array about the centerline 12 and the rotor 50. Each of the BOAS segments 64 may have an arcuate geometry that extends partially about the centerline 12 from, for example, about one degree (1°) to about twelve degrees (12°). The present disclosure, however, is not limited to the foregoing exemplary blade outer air seal or BOAS segment configurations. For example, in other embodiments, one or more of the BOAS segments 64 may have an arcuate geometry that extends more than twelve degrees.

Figure 3:
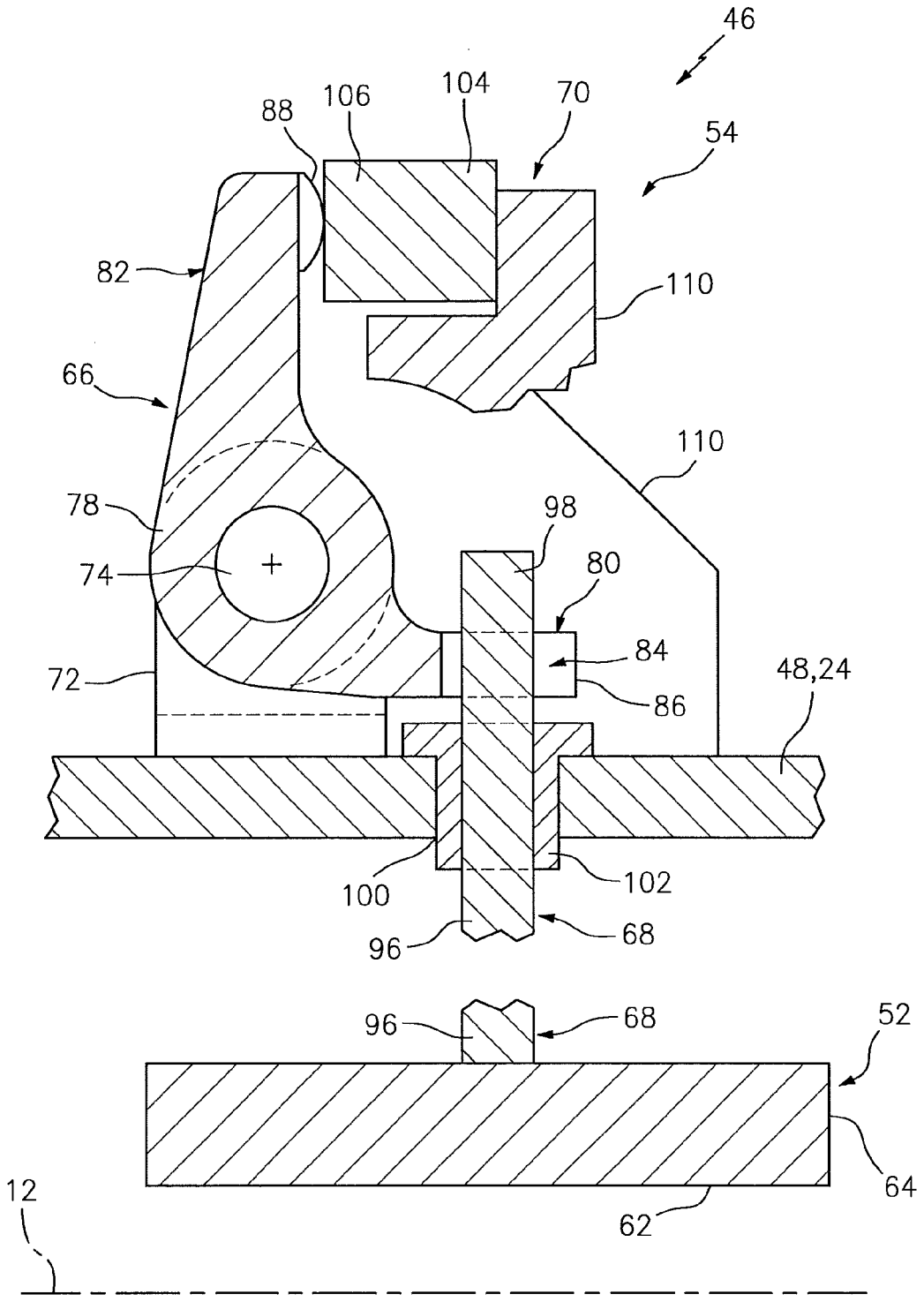
FIG. 3 is a side sectional illustration of a portion of the assembly.

The tip clearance control system 54 includes a plurality of rocker arms 66, a plurality of linkages 68 and an actuation device 70. The rocker arms 66 are arranged in an array circumferentially around the centerline 12 and a radial exterior of the turbine engine case 48. Referring to FIG. 3, each of the rocker arms 66 is pivotally connected to the turbine engine case 48. Each of the rocker arms 66, for example, may be pivotally connected to a respective rocker arm mount 72 by a pin or shaft 74, where the rocker arm mount 72 is mounted (directly or indirectly) to the turbine engine case 48 by one or more fasteners 76; see FIG. 5.

Figure 4:
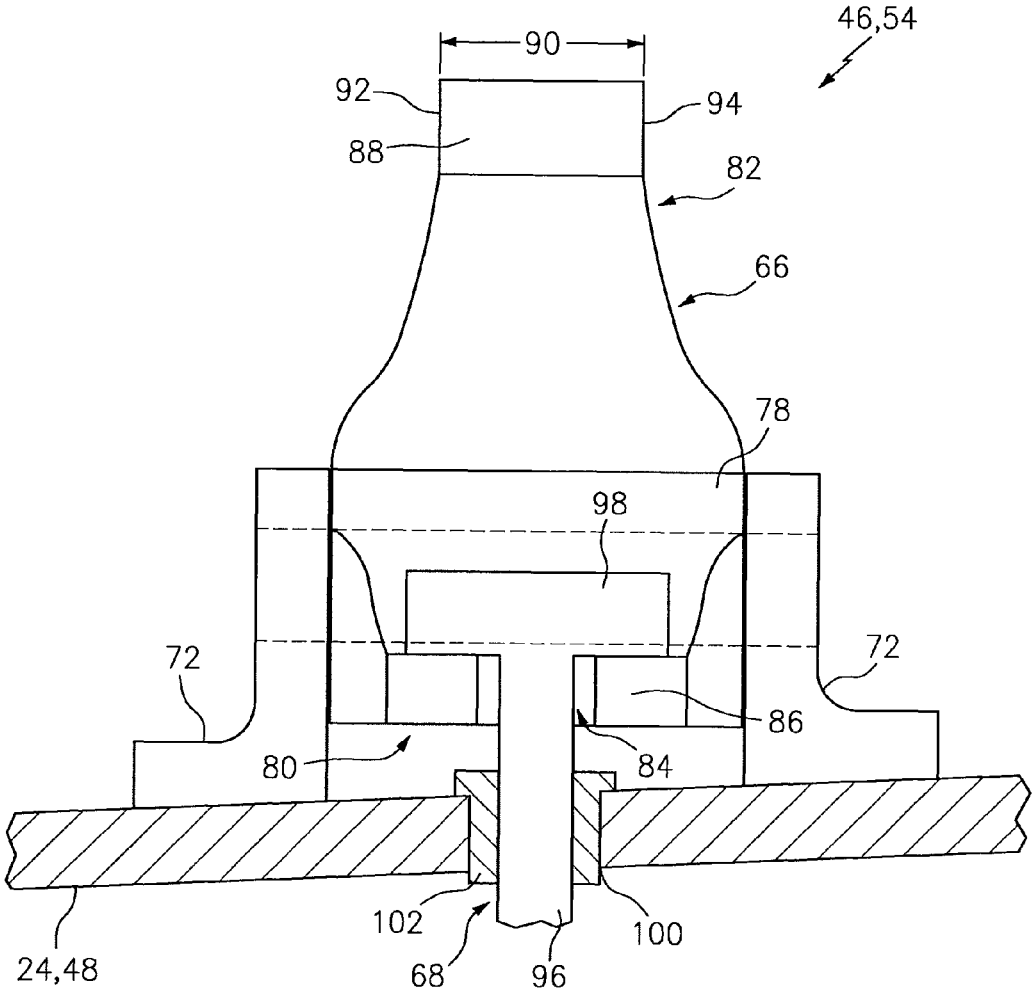
FIG. 4 is an end cutaway illustration of the assembly portion.
Figure 5:
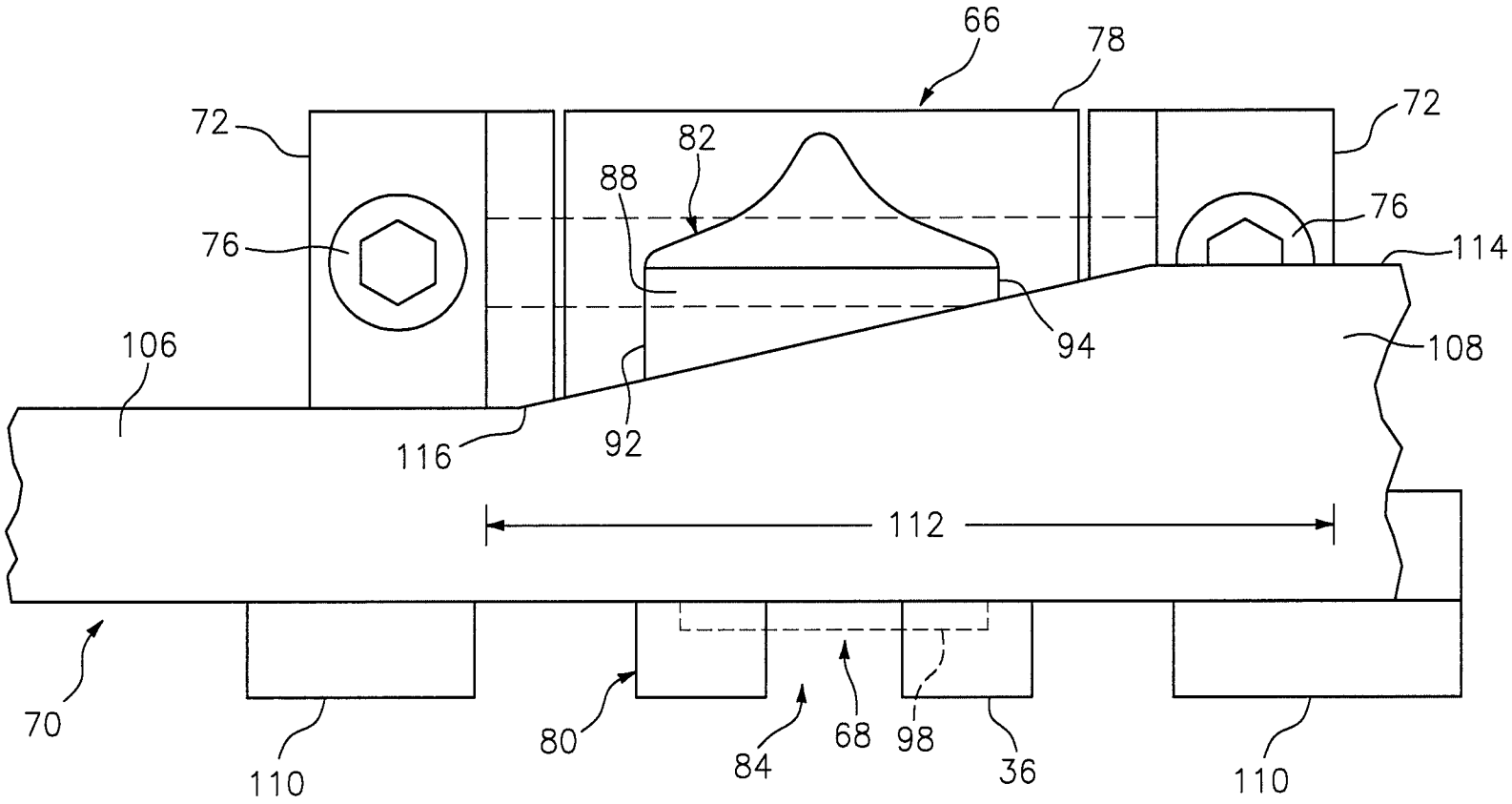
FIG. 5 is an illustration of an exterior of the assembly portion.

Referring now to FIGS. 3-5, each of the rocker arms 66 includes a base 78 that is pivotally attached to the respective rocker arm mount 72. Each of the rocker arms 66 also includes a linkage arm 80 and an actuator arm 82. Each of these arms 80 and 82 projects from the base 78. The linkage arm 80 of FIG. 3, for example, projects substantially axially (relative to the centerline 12) from the base 78. The actuator arm 82 of FIG. 3 projects substantially radially outward (relative to the centerline 12) from the base 78. The actuator arm 82 may be clocked from the linkage arm 80 by between, for example, between about eighty-five degrees (85°) and about ninety-five degrees (95°); e.g., about ninety degrees (90°) such that the arms 80 and 82 are perpendicular to one another. The present disclosure, however, is not limited to the foregoing exemplary rocker arm orientations.

The linkage arm 80 may include an aperture such as a channel 84. This channel 84 extends radially through the linkage arm 80. The channel 84 also extends axially into the linkage arm 80 from a distal end 86 thereof. The channel 84 thereby provides the linkage arm 80 with a forked end configuration.

The actuator arm 82 may include a slide block 88. This slide block 88 has a tapered thickness which changes along a lateral (e.g., circumferential or tangential) width 90 (see FIG. 4) of the slide block 88. More particularly, one end 92 of the slide block 88 projects axially beyond (e.g., aft or forward of) the other end 94 of the slide block 88, as best seen in FIG. 5.

Referring to FIG. 2, the linkages 68 are arranged in an array circumferentially around the centerline 12 and the blade outer air seal 52. A radial inner end of each of linkages 68 is connected (directly or indirectly) to a respective one of the BOAS segments 64. A radial outer end of each of the linkages 68 is connected to a respective one of the rocker arms 66. More particularly, the linkage arm 80 of FIGS. 3 and 4 include a shaft 96 and a head 98. The shaft 96 extends radially away from the respective BOAS segment 64, through an aperture 100 in the turbine engine case 48 and the channel 84, and to the head 98. The head 98 is radially engaged (e.g., abutted against and contacting) the linkage arm 80. The head 98 may be configured to substantially prevent or otherwise limit rotation of the shaft 96 about an axis thereof. A bushing 102 may be configured within the aperture 100 and mated with the shaft 96 to substantially prevent or otherwise limit rocking (e.g., lateral and/or axial movement) of the shaft 96. In this manner, the linkage 68 is substantially constrained to radial translation as described below.

Referring to FIGS. 3 and 5, the actuation device 70 includes a rotatable actuation ring 104, a plurality of slide blocks 106 and an actuator 108 (see FIG. 2). This actuator 108 is configured to laterally move (e.g., circumferential rotate) the actuation ring 104 about the centerline 12. The actuator 108 may be configured as, but is not limited to, any type of electrical, hydraulic or other motor.

The actuation ring 104 circumscribes the centerline 12 and the radial exterior of the turbine engine case 48. The actuation ring 104 is mated with one or more supports 110, which are mounted to the turbine engine case 48. These supports 110 may guide circumferential rotation of the actuation ring 104.

The slide blocks 106 are arranged in an array circumferentially around the centerline 12 and the turbine engine case 48. Each of the slide blocks 106 is configured axially between the actuation ring 104 and a respective one of the actuator arms 82. More particularly, each of the slide blocks 106 may be configured as part of (e.g., formed integrally/monolithically with) or otherwise connected (e.g., mechanically fastened, bonded and/or otherwise attached) to the actuation ring 104 as well as axially engage (e.g., laterally slidably contact) a respective one of the slide blocks 88.

Each slide block 106 has a tapered thickness which changes along a lateral (e.g., circumferential or tangential) width 112 of the slide block 106. More particularly, one end 114 of the slide block 106 projects axially beyond (e.g., forward or aft of) the other end 116 of the slide block 106, as best seen in FIG. 5. It is worth noting, corresponding slide blocks 88 and 106 are tapered in opposite directions. In this manner, circumferential movement of the actuation ring 104 may axially move the actuator arms 82. For example, counter-clockwise rotation (e.g., movement towards a left-hand-side of the page) of the actuation ring 104 of FIGS. 3 and 5 may axially move the actuator arms 82 away from the ring 104. In contrast, clockwise rotation (e.g., movement towards a right-hand-side of the page) of the actuation ring 104 of FIGS. 3 and 5 may axially move the actuator arms 82 towards the ring 104.

During turbine engine 10 operation, one or more of the system 46 components may undergo thermally distortion; e.g., expand, contract, warp, etc. The different components may be subject to varying degrees of distortion depending upon their proximity to the core gas path 42. To accommodate different degrees of thermal distortion between the components, the tip clearance control system 54 is operated to maintain a minimum (or no) gap between the tips 60 of the rotor blades 58 and the blade outer air seal 52. For example, when a gap between the tips 60 and the blade outer air seal 52 increases, the actuator 108 may rotate the actuation ring 104 clockwise and thereby axially move the actuator arms 82 towards the ring 104 and radially move the linkage arms 80 towards the turbine engine case 48. The movement of the linkage arms 80 enable the linkages 68 and the BOAS segments 64 to move radially inwards towards the tips 60. Note, typically air pressure between the turbine engine case 48 and the BOAS segments 64 is greater than air pressure within the core gas path 42 which provides a motive force for pushing the BOAS segments 64 radially inward. In another example, when a gap between the tips 60 and the blade outer air seal 52 decreases, the actuator 108 may rotate the actuation ring 104 counter-clockwise and thereby axially move the actuator arms 82 away from the ring 104 and radially move the linkage arms 80 away from the turbine engine case 48. The linkage arms 80 may in turn move the linkages 68 and, thus, the BOAS segments 64 radially outward.

The components of the tip clearance control system 54 may also be subject to varying degrees of thermal distortion and, thus, relative movement therebetween. For example, the rocker arms 66 may move radially relative to the actuation device 70 due to thermal distortion. In prior art systems, such relative movement may also cause movement of attached BOAS segments as described above. The slide blocks 88 of the present disclosure, in contrast, may slide radially against the slide blocks 106 without causing rotation of the rocker arms 66. The tip clearance control system 54 of the present disclosure therefore may not be subject to varying operability as components thereof are subject to different thermal distortions.

The BOAS segments 64 described above and illustrated in the drawings are discloses as being uniquely associated with a single one of the linkages 68 and a single one of the rocker arms 66. However, in other embodiments, one or more of the BOAS segments 64 may be connected to two or more linkages 68 and thus operatively coupled with two or more rocker arms 66.

In some embodiments, the slope each of the slide blocks 106 may be substantially the same. In this manner, each of the BOAS segments 64 may move approximately an equal radial distance. In other embodiments, the slope of at least one of the slide blocks 106 may be different than the slope of another one of the slide blocks. In this manner, one or more of the BOAS segments 64 may move a different radial distance than at least one other BOAS segment 64. Such a configuration may be beneficial where the case and/or other components asymmetrically deform during operation. Such asymmetrically deformation may be caused by positioning turbine cooling pipes around the circumference of the turbine engine.

The turbine engine assembly 46 may be included in various turbine engines other than the one described above. The turbine engine assembly 46, for example, may be included in a geared turbine engine where a gear train connects one or more shafts to one or more rotors in a fan section, a compressor section and/or any other engine section. Alternatively, the turbine engine assembly 46 may be included in a turbine engine configured without a gear train. The turbine engine assembly 46 may be included in a geared or non-geared turbine engine configured with a single spool, with two spools (e.g., see FIG. 1), or with more than two spools. The turbine engine may be configured as a turbofan engine, a turbojet engine, a propfan engine, a pusher fan engine or any other type of turbine engine. It is also worth noting the turbine engine assembly 46 may be included in turbine engines other than those configured for an aircraft (e.g., airplane or helicopter) propulsion system. The turbine engine assembly 46, for example, may be configured for an industrial gas turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. An assembly for a turbine engine with an axial centerline, comprising:

a blade outer air seal segment;

a linkage attached to the blade outer air seal segment;

a rocker arm including a first arm and a second arm engaged with the linkage; and an actuation device engaged with the first arm, the actuation device configured to pivot the rocker arm and thereby radially move the blade outer air seal segment;

wherein the linkage includes a shaft and a head that radially engages the second arm, and the shaft extends radially away from the blade outer air seal segment, through an aperture in the second arm, and to the head.

2. The assembly of claim 1, further comprising a turbine engine case, wherein the linkage extends radially through an aperture in the turbine engine case.

3. The assembly of claim 2, wherein the rocker arm further includes a base pivotally attached to the turbine engine case, and the first and the second arms project out from the base.

4. The assembly of claim 3, wherein the second arm projects axially out from the base, and the first arm projects radially out from the base.

5. The assembly of claim 3, wherein the first arm is clocked from the second arm by between eighty-five degrees and ninety-five degrees.

6. The assembly of claim 1, wherein the actuation device laterally and radially slideably contacts the first arm.

7. The assembly of claim 1, wherein the actuation device includes a sloped slide block which axially engages the first arm, and the actuation device is configured to laterally move the sloped slide block and thereby axially push the first arm with the sloped slide block.

8. The assembly of claim 7, wherein the actuation device further includes a rotatable actuation ring to which the sloped slide block is connected.

9. The assembly of claim 1, wherein the linkage extends radially from the blade outer air seal segment to the second arm, and the second arm is operable to radially translate the linkage.

10. The assembly of claim 9, wherein the linkage is substantially constrained to radial translation.

11. The assembly of claim 1, further comprising a rotor with a plurality of rotor blades, wherein each of the rotor blades extends radially outward to a tip, and the actuation device is operable to radially move the blade outer air seal segment to reduce air leakage between the tip and the blade outer air seal segment.

12. An assembly for a turbine engine with an axial centerline, comprising:

a blade outer air seal segment extending circumferentially about the axial centerline;

a linkage attached to the blade outer air seal segment;

a rocker arm including a first arm and a second arm engaged with the linkage; and an actuation device engaged with the first arm, the actuation device configured to pivot the rocker arm and thereby radially move the blade outer air seal segment;

wherein the actuation device axially, relative to the axial centerline, engages the first arm.

13. An assembly for a turbine engine with an axial centerline, comprising:

a blade outer air seal segment;

a linkage attached to the blade outer air seal segment;

a rocker arm including a first arm and a second arm engaged with the linkage; and an actuation device engaged with the first arm, the actuation device configured to pivot the rocker arm and thereby radially move the blade outer air seal segment;

wherein the actuation device is operable to move radially relative to the first arm without pivoting the rocker arm.

14. An assembly for a turbine engine with an axial centerline, comprising:

a plurality of blade outer air seal segments arranged around the axial centerline;

a tip clearance control system including a plurality of rocker arms and an actuation ring, the rocker arms arranged around the blade outer air seal segments, wherein each of the rocker arms is operatively connected between a respective one of the blade outer air seal segments and the rotatable actuation ring, and wherein the actuation ring is configured to circumferentially rotate and thereby cause the rocker arms to pivot and move the blade outer air seal segments.

15. The assembly of claim 14, wherein the tip clearance control system further includes a plurality of linkages, and each of the linkages is engaged with and extends radially between a respective one of the blade outer air seal segments and a respective one of the rocker arms.

16. The assembly of claim 14, wherein the tip clearance control system further includes a plurality of sloped slide blocks which respectively axially engage the rocker arms and are connected to the actuation ring, and wherein the actuation ring is configured to circumferentially move the sloped slide blocks and thereby axially push against the rocker arms.

17. The assembly of claim 14, further comprising a turbine engine case radially between the blade outer air seal segments and the rocker arms.

18. The assembly of claim 17, wherein each of the rocker arms includes a base, a first arm and a second arm, the base is pivotally attached to the turbine engine case, the first and the second arms project out from the base, the second arm is operatively connected with a respective one of the blade outer air seal segments, and the first arm is operatively connected with the actuation ring.

19. The assembly of claim 18, wherein the second arm projects axially out from the base, and the first arm projects radially out from the base.

20. The assembly of claim 15, wherein a first of the rocker arms includes a base, a first arm and a second arm, the base is pivotally attached to the turbine engine case, the first and the second arms project out from the base, the second arm is operatively connected with a respective one of the blade outer air seal segments, and the first arm is operatively connected with the actuation ring; and a first of the linkages includes a shaft and a head that radially engages the second arm, and the shaft extends radially away from a first of the blade outer air seal segments, through an aperture in the second arm, and to the head.

* * * * *